United States Patent [19]

Spencer et al.

[11] 4,061,203

[45] Dec. 6, 1977

[54] LADDER ATTACHMENT

[75] Inventors: Frederick J. Spencer, Hinsdale; Edward Spencer, LaGrange, both of Ill.

[73] Assignee: Spencer Tool & Mfg. Co. Inc., Chicago, Ill.

[21] Appl. No.: 772,932

[22] Filed: Feb. 28, 1977

[51] Int. Cl.[2] ..... E06C 7/48

[52] U.S. Cl. ..... 182/214

[58] Field of Search ..... 182/214, 107, 108; 248/210, 211, 238

[56] References Cited

U.S. PATENT DOCUMENTS

| | | | |
|---|---|---|---|
| 1,467,597 | 9/1923 | Wendel | 182/214 |
| 2,592,006 | 4/1952 | Burke | 182/214 |
| 2,597,902 | 5/1952 | Roketa | 182/214 |
| 3,288,249 | 11/1966 | Gibson | 182/214 |
| 3,318,416 | 5/1967 | Robinson | 182/214 |
| 3,459,277 | 8/1969 | Frederick | 182/214 |
| 3,773,143 | 11/1973 | Prete | 182/214 |

*Primary Examiner*—Reinaldo P. Machado
*Attorney, Agent, or Firm*—Rummler & Snow

[57] ABSTRACT

A device for attachment to a ladder which enables the upper end of a ladder to be spaced from the wall of the building, span windows and/or rest on a slant roof and thus span the gutters. The device also acts as a stabilizer bar or tube to prevent slippage of the ladder laterally, gives greater stabilization to the ladder, and almost automatically positions the ladder at the correct angle of inclination away from the lower wall of a building, and generally promotes a greater margin of safety. Also, the device is readily separable after use for small compact storage.

3 Claims, 12 Drawing Figures

FIG-1
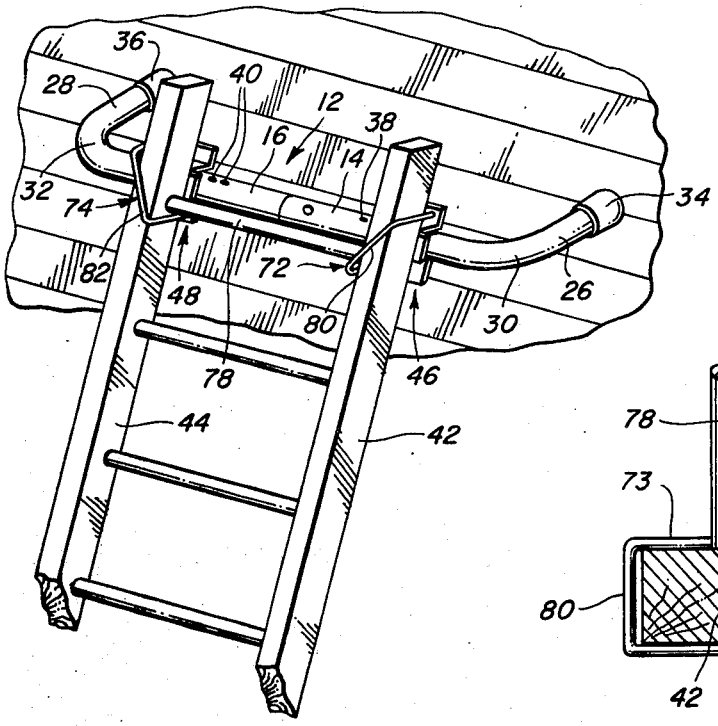
FIG-3
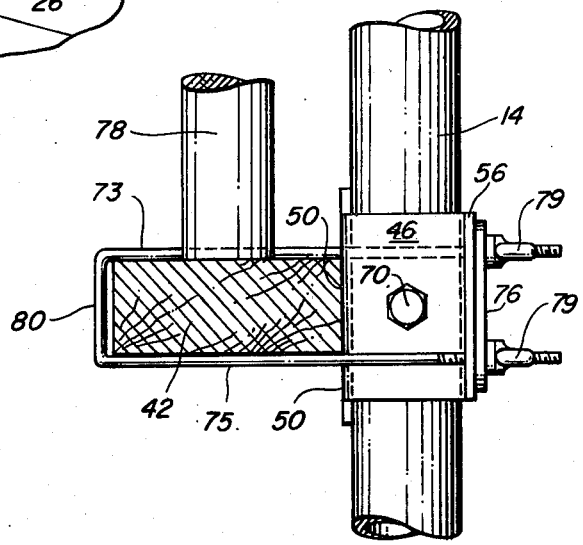
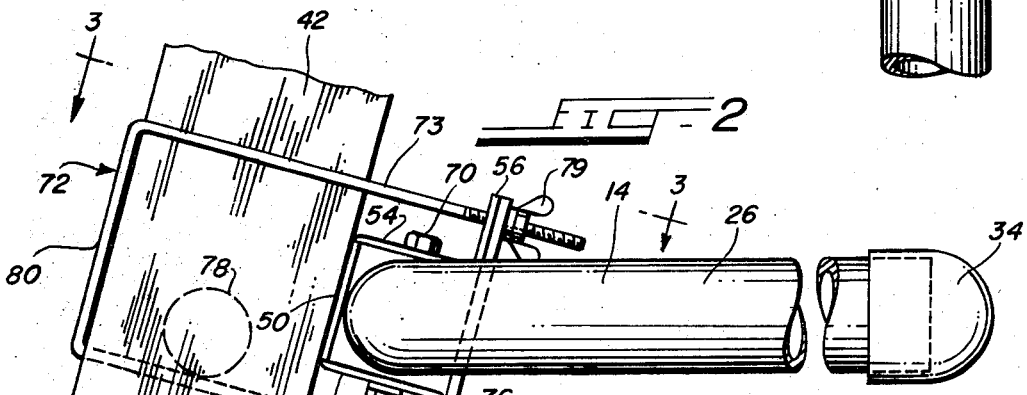
FIG-2
FIG-12
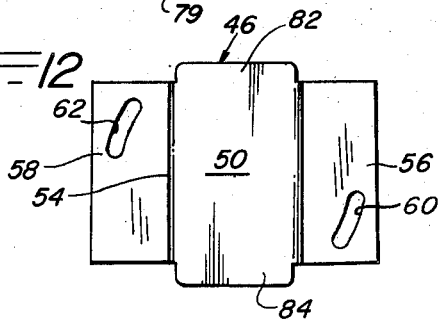
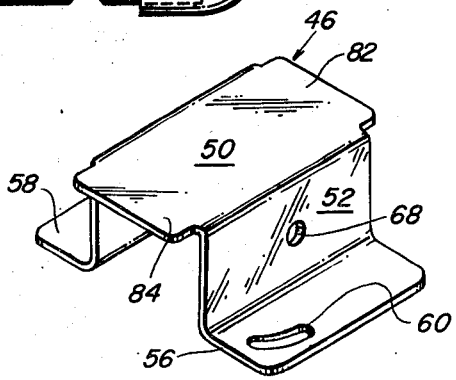
FIG-10

LADDER ATTACHMENT

SUMMARY OF THE INVENTION

An anti-sway or stabilizer device arranged to extend outwardly of the rails of a ladder and be secured adjacent to the upper ends thereof and for spacing the upper ends of the ladder away from the surface on which the ladder upper ends normally rest, which device is provided with a two-piece, U-frame, removably anchored together, and having a pair of U-shaped brackets which are removably secured on said frame in spaced adjustable relationship, and at a distance equal to the width of the upper ends of the rails of the ladder at the uppermost ladder rung. Each of the brackets has right angled flanges extending outwardly from the lower ends of the side walls of the bracket, each of said flanges having spaced arcuately positioned slots, the slots on each pair of flanges each extending in opposite directions. U-bolts are provided to extend around the upper end of each of the ladder rails and uppermost rung and to be anchored to said flanges. Means are provided in the device to adapt it to any width ladder. This device when disassembled is compact and may be stored in a relatively small area.

BACKGROUND OF THE INVENTION

Ladders, especially extension ladders, have had anti-sway devices attached to the upper ends thereof but they are usually clumsy and made in one piece, and are generally complicated.

A search of the patent files was conducted in Class 182, Subclasses 106, 173, 177, 229, 230 and 214, and the most pertinent art developed was:

U.S. Pat. No. 2,993,562 to Hussey, 7/61
U.S. Pat. No. 3,288,249 to Gibson, 11/66
U.S. Pat. No. 3,653,462 to Courtney, 4/72
U.S. Pat. No. 3,568,801 to Werner, 3/9/71

All these patents fall in the category expressed hereinabove.

BRIEF DESCRIPTION OF THE DRAWINGS

FIG. 1 is a perspective view showing the device of the present invention positioned on the upper end of a ladder and abutting against a wall;

FIG. 2 is a side elevational view of the upper end of FIG. 1;

FIG. 3 is a cross-sectional view taken on the line 3—3 of FIG. 2;

FIG. 10 is a perspective view of the bracket;

FIG. 12 is a top plan of the device of FIG. 10.

DETAILED DESCRIPTION OF THE DRAWINGS

Figure 7:
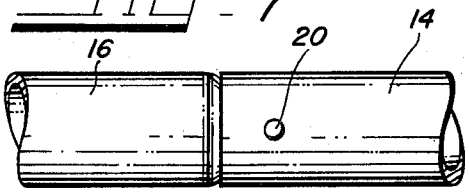
FIG. 7 is a front elevational view, with parts broken away, showing the bight portions of the stabilizer bar joined together.
Figure 8:
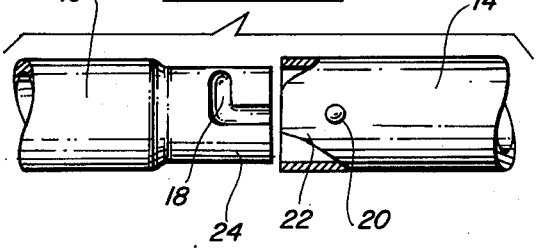
FIG. 8 is an exploded view of the two sections disclosing the bayonet configuration and detent.

A knockdown anti-sway or stabilizer for ladders comprises preferably a tubular frame 12 composed of two horizontal members or portions 14, 16 removably joined together by a bayonet-type recess 18 and a detent 20 (see FIGS. 7 and 8). The detent 20 rides in the grooves of the bayonet-type recess 18 and being formed by punching the outer surface of the end portion 22 of member 16 inwardly adjacent the end thereof, as shown. It is also to be noted from FIG. 8 that the end 24 is of reduced diameter to be readily insertable in the end 22 of the member 16 and by a clockwise motion of members 14, 16 effectively producing a latching action of the two portions 14, 16. The length of the reduced diameter 24 is preferably about three inches.

The ends 26, 28 of each member 14, 16, respectively, are bent at substantially right angles with a large radius 30, 32 to form legs which are capped on their ends with a rubber or plastic cap 34, 36, respectively.

Figure 11:
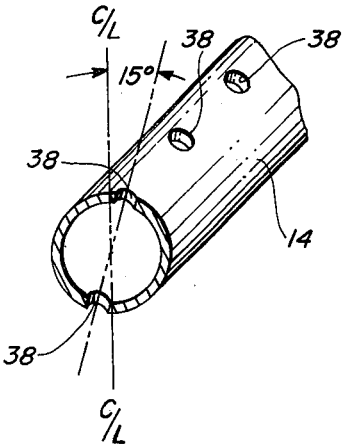
FIG. 11 is a perspective view of one of the members showing the position of the spacing apertures therein.

The members 14, 16 are each provided with a multiple series of spaced through apertures 38, 40 drilled at an angle of about 15° from the vertical center line which lies normal to the axis of the members 14, 16 (see FIG. 11) if such members and their respective legs 26, 28 were laid on a flat surface. There are normally four spaced apertures on each member 14, 16. The purpose of the series of apertures 38, 40 is to accommodate the varying widths between rails 42, 44 adjacent their upper ends which vary between manufacturers and sizes of ladders, in the main, from about thirteen inches all the way up to eighteen and one-half inches and inbetween. Thus the present device is usable on substantially all ladders manufactured excepting, of course, step ladders with their hinged supporting frame. The purpose of drilling the apertures at an angle of 15° from the vertical axis of the members 14, 16 is to substantially require that the ladders be set at this angle from the vertical whereby the base of the ladder is approximately twelve inches further away from the lower wall of the building against which the present stabilizer abuts than is recommended by the ladder manufacturer for safe use, thus increasing the safety factor in use.

A pair of U-shaped brackets 46, 48 are anchored on members 14, 16 and each bracket comprises a top wall 50, a pair of side walls 52, 54 and flanges 56, 58 extending laterally outwardly from the lower ends of the side walls 52, 54, respectively. It is to be noted especially from the drawings that the top and walls are elongated and wide. Flanges 56, 58 integrally formed on each side wall are each provided with spaced arcuate slots 60, 62 each extending at the same angle but arranged catercornered from one another. The side walls 52, 54 are provided with aligned apertures 68. The purpose of all these apertures and slots will be explained hereinafter.

Figure 4:
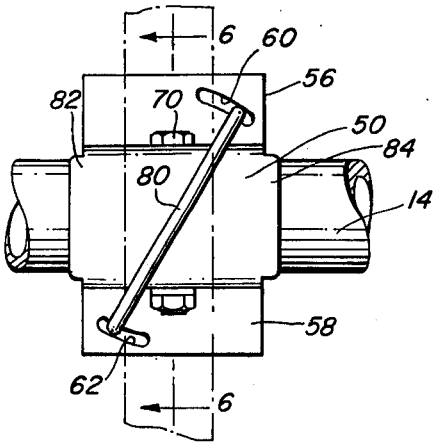
FIG. 4 is a front elevational view of one of the brackets secured to the device and also showing the U-bolt enveloping the side frame of the ladder which is shown in broken lines.
Figure 5:
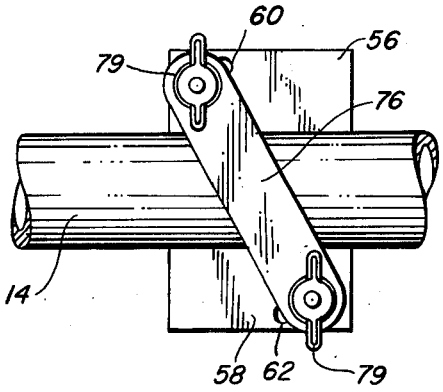
FIG. 5 is a rear elevational view of the device shown in FIG. 4.
Figure 6:
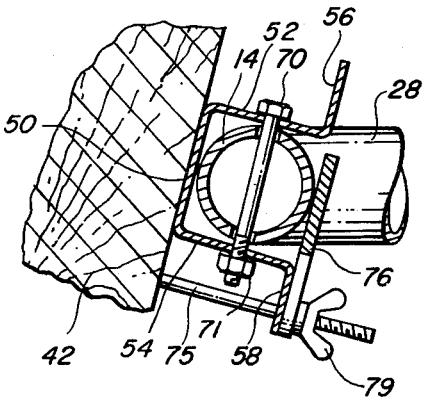
FIG. 6 is a cross-sectional view taken on the lines 6—6 of FIG. 4.
Figure 9:
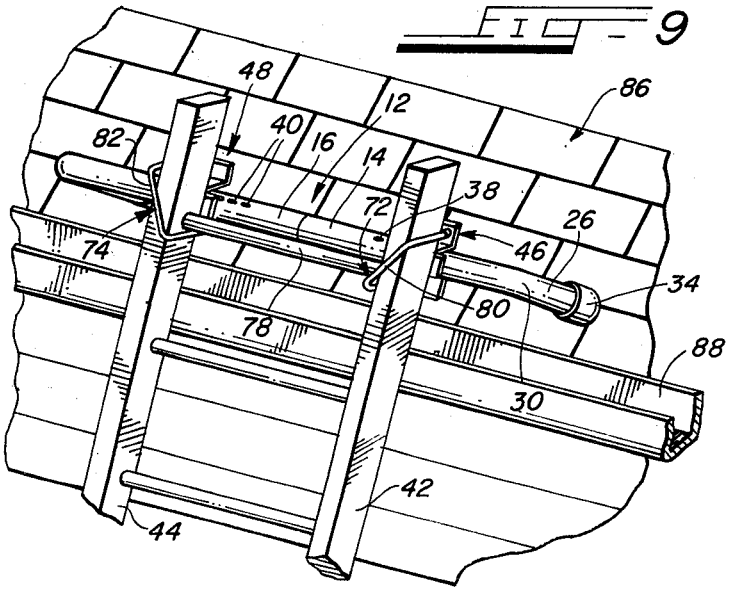
FIG. 9 is a perspective view similar to FIG. 1 but showing the terminal ends of the stabilizer bearing on the surface of the roof.

In assembling the device of the present invention, each of the brackets 46 is placed on the members 14, 16 so that the inner surfaces of side walls 52, 54 and top wall 50 substantially envelope the members 14, 16 respectively, and in spaced relation to each other, as shown in FIGS. 1 and 9, with the apertures 68 aligned with the appropriate aligned apertures 40 in the members 14, 16. This, of course, is determined by the width of the ladder rails 42, 44. Each bracket is then bolted to the members 14, 16 by bolts 70, only one of which is shown in the drawings, by inserting the bolts through the respective apertures 38, 40, 68. This solidly anchors the brackets to the respective members 14, 16. The upper surface of top wall 50 of each bracket 46 is then placed against inner end walls of the side frames or rails 42, 44, respectively, adjacent the upper ends thereof and on the side of the ladder that will face the building and the U-bolts 72, 74, each having legs 73, 75, are positioned around the end wall of the side rails 42, 44 and around the uppermost rungs of the ladder and into and through the respective slots 60, 62. Thus the U-bolts are positioned angularly (see FIGS. 1, 4 and 9) on the rails 42, 44. Plates 76 are each provided with spaced apertures adjacent each end. The plate is then placed against flanges 56, 58 and the free ends of the legs 73, 75 of the U-bolt inserted through the apertures in plate 76. Appropriate wing nuts 79 are then threaded on the legs 73, 75, respectively, and tightened with the fingers of the user. It should thus appear that the stabilizer bar is securely anchored to the upper end of the side rails and uppermost rung 78 of the ladder (see FIGS. 1 and 9).

As shown in the drawing, the connector members 80, 82 of the U-bolts 72, 74 each lie in opposed directions. This is the preferable manner of employing the U-bolt 72 on the ladder.

The ends of the top wall 50 extend outwardly beyond the ends of side walls 52, 54 to lend more support for the members 14, 16, as well as to strengthen the bracket per se.

To disassemble, the U-bolts 72, 74 are removed after removing the wing nuts 79 and plates 76. The stabilizer bar can now be removed from the upper end of the ladder. By rotatng the members 14, 16 in a counterclockwise direction and shifting the members laterally outward, the detent 20 will be removed from the bayonet recess 18 and the device becomes one-half the size for ready storage.

For the sale of the stabilizer bar, the device is knocked down as above described and can be placed with all its parts in a relatively flat box for sale and is readily stackable in a small area in a warehouse, store, basement or garage. When packaged, the device can readily be handled and carried by the buyer or user.

Dimension-wise, the overall length of the stabilizer bar in assembled positioned is approximately four feet, and from the tips 34, 36 to the members 14, 16 is about twenty-one inches. The members 14, 16 are approximately one and one-half inches in diameter and preferably a steel tube of heavy gauge but, of course, these members may be made of bar stock or any metal, or even plastic.

The stabilizer structure of the present invention may be attached to ladders constructed of any material.

It should also be observed that when the structure of the present invention is very quickly attached to the upper end of a ladder, it will readily span the ordinary windows in a home or factory and may even have the ends of the tips 34, 36 of legs 26, 28 placed on a slanted roof 86 to readily span the gutters 88 and allow workmen to paint and clean the gutters with greater freedom than heretofore.

It should be obvious that the end 24 may be enlarged to slip over the end 22 and the bayonet slot and detent be reversed, i.e. the bayonet slot impressed on member 22 and the detent impressed on end 24, and the results would be the same as heretofore set out.

It is also to be appreciated that the present device is so structured that no apertures or slots are formed in the ladder rails in incorporating this device on the ladder. Therefore the ladder strength as designed and built by the manufacturer remains.

It will be understood that numerous details of the construction shown may be altered or omitted without departing from the spirit of the invention as defined by the following claims.

We claim:

1. A knockdown antisway or stabilizer device for the upper end of an extension ladder having a pair of side rails and rungs comprising, in combination:

a. a pair of horizontal elongated tubular members removably secured together end to end, the free end of said members being bent at right angles to said horizontal portion of said members and both bent in the same direction to form legs;

b. a pair of U-shaped angle brackets each having a pair of spaced side walls and a connector top wall, and outwardly extending flanges on the free ends of said side walls, each of said flanges having an arcuate slot formed therein and arranged cater-cornered from each other, each side wall having opposed apertures therein;

c. means for removably securing said brackets one to each of said members in spaced relation; and d. a pair of U-shaped bolts having legs for anchoring said brackets and members to the rails of said ladder and about the uppermost rung thereof.

2. The device according to claim 1 wherein each U-bolt extends around a rail and the upper rung of the ladder with a portion of the legs and extending through said arcuate slots in said flanges, and plates having spaced apertures through which said legs extend and means for securing said plate against each of said members.

3. The device according to claim 2 wherein each of said members is provided with a series of spaced apertures extending at about a 15° angle from a vertical centerline lying normal to the axis of said members, and said means for removably securing said brackets are bolts which extend through said apertures in the side walls of said brackets and through the aperture in said members and are anchored with nuts.

* * * * *